US005865548A

United States Patent [19]

Wen et al.

[11] Patent Number: 5,865,548

[45] **Date of Patent: *Feb. 2, 1999**

[54] COATED PLATEN ROLLER FOR IMPROVING REGISTRATION IN A PLATEN-DRIVE RESISTIVE THERMAL PRINTER

[75] Inventors: Xin Wen, Rochester; William Irvin Morris, Oakfield; Steven J. Sparer, Rochester, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 697,323

[22] Filed: Aug. 23, 1996

[51] Int. Cl.[6] ..... B41J 11/057

[52] U.S. Cl. ..... 400/662; 400/120.02; 347/220

[58] Field of Search ..... 400/120.02, 662; 347/220

[56] References Cited

U.S. PATENT DOCUMENTS

| | | | |
|---|---|---|---|
| 4,092,920 | 6/1978 | Barnak | 101/77 |
| 4,172,418 | 10/1979 | Durand | 101/194 |
| 4,957,378 | 9/1990 | Shima | 101/120 |
| 5,078,519 | 1/1992 | Takita et al. | 400/120 |
| 5,123,151 | 6/1992 | Uehara et al. | 29/130 |
| 5,169,247 | 12/1992 | Asano et al. | 400/185 |
| 5,244,861 | 9/1993 | Campbell et al. . | |
| 5,597,251 | 1/1997 | Suzuki et al. | 400/643 |

FOREIGN PATENT DOCUMENTS

| | | |
|---|---|---|
| 1-058572 | 3/1989 | Japan . |

*Primary Examiner*—Edgar Burr
*Assistant Examiner*—Daniel J. Colilla
*Attorney, Agent, or Firm*—Norman Rushefsky

[57] ABSTRACT

A resistive thermal printer has a platen drive mechanism which includes (1) a thermal printhead having an array of selectively-activatable thermal elements and (2) a rotatably-driven platen roller opposed to the printhead and forming a nip with the printhead through which a receiver medium is driven by the platen roller while the thermal elements are selectively activated. The platen roller has an outer layer of perfluorinated polymer. The platen roller includes a compliant layer below the outer layer of perfluorinated polymer.

11 Claims, 2 Drawing Sheets

COATED PLATEN ROLLER FOR IMPROVING REGISTRATION IN A PLATEN-DRIVE RESISTIVE THERMAL PRINTER

CROSS-REFERENCE TO RELATED APPLICATIONS

Reference is made to commonly assigned, co-pending U.S. patent application Ser. No. 80/641,250 entitled THERMAL PRINTER WHICH RECIRCULATES RECEIVER SHEET BETWEEN SUCCESSIVE PRINTING PASSES, which was filed in the names of Maslanka et al. on Apr. 30, 1996.

BACKGROUND OF THE INVENTION

Technical Field

This invention relates to resistive thermal printing, and, more particularly, to resistive thermal printing of the type in which a dye donor medium and a dye receiver medium are fed between a resistive thermal printhead and a compliant platen roller for image-wise transfer of image material contained on the dye donor medium to the dye receiver medium. It is particularly useful in a printer in which successive dye images in different colors are transferred to the receiver medium in registration to form a multicolor dye image on the dye receiver medium.

Background Art

In a resistive thermal printer, a dye receiver medium, such as a sheet or web, and a donor medium are fed together through a printing nip between a resistive thermal printhead and a rotatable platen. The printhead image-wise heats the donor medium to transfer dye or another image material in image configuration to the receiver medium as the donor medium and receiver medium pass through the nip. To make multicolor images, the receiver medium is passed again through the nip with a different color dye donor medium.

As is well known in the art, a resistive thermal printhead utilizes a row of closely spaced resistive elements which are selectively energized to record data in hard copy form. The resistive elements receive energy from a power supply through driver circuits in response to the stored digital information related to text, bar codes, pictorial, or graphical images. The heat from each energized element may be applied directly to thermal sensitive material or to a dye-coated donor medium to cause transfer of the dye by diffusion to paper or other receiver medium material.

The receiver medium transport mechanism in a resistive thermal dye transfer print engine requires two mechanical functions. First, compliance must be provided to the receiver medium at the printhead-receiver medium interface so that images can be printed uniformly on the receiver medium. Second, a receiver medium transport that is repeatable to all color planes is necessary.

Three resistive thermal printer mechanisms are shown in FIGS. 1–3. FIG. 1 illustrates a printer 10 having a platen roller 12 to which a receiver medium 14 is attached by a clamp 16. The platen roller provides compliance at the nip interface between the platen roller and a printhead 18. FIG. 2 shows a printer 20 having a platen roller 22 and a pair of pinch rollers 24 and 26 which drives receiver medium 28 through the nip of platen roller 22 and a printhead 30. In the prior art embodiments of FIGS. 1 and 2, clamp 16 and pinch rollers 24 and 26, respectively, tightly hold the receiver medium during the printing of all color planes.

FIG. 3 shows a printer 32 with a platen-drive mechanism disclosed in commonly assigned, co-pending U.S. patent application Ser. No. 08/641,250 entitled THERMAL PRINTER WHICH RECIRCULATES RECEIVER SHEET BETWEEN SUCCESSIVE PRINTING PASSES, which was filed in the names of Maslanka et al. on Apr. 30, 1996. A receiver medium 34 is moved through a closed loop path (partially shown) to accomplish a plurality of passes through a nip between a resistive thermal printhead 36 and a platen roller 38. The platen roller itself drives the receiver medium and a donor medium 40 through the nip, simplifying the apparatus. The two functions of compliance and transport are both fulfilled by the platen roller. This platen-drive mechanism has the advantages of fewer parts, and thus lower cost, compared to the two mechanisms of FIGS. 1 and 2. However, since receiver medium 34 is not firmly held by any mechanical parts, misregistration between color planes may occur in this mechanism.

A platen roller in a resistive thermal printer is typically comprised of a rigid shaft, usually made of metal for mechanical strength, and an elastomer layer wrapped around the shaft for compliance. In U.S. Pat. No. 5,078,519, the receiver medium is transported by a capstan-roller mechanism. During printing, the slack in the receiver medium between the axes of the platen roller and the capstan rollers causes skew distortion on the print. Since the receiver medium is driven by both the pair of pinch rollers and the platen roller, the slack in the receiver medium tends to stay during the printing process. If the receiver medium can be allowed to slide on the platen roller, the slack in receiver medium can be eliminated. The technique disclosed in U.S. Pat. No. 5,078,519 is to decrease the coefficient of friction between the receiver medium and the platen roller by coating a layer of TEFLON™ resin (perfluorinated ethylenepropylene) on the outer surface of the platen roller. TEFLON™ is a trademark of Du Pont EI De Nemours Company, located in Wilmington, Del.

Color misregistration in platen-drive resistive thermal printers originates from the sensitivity of the elastomer layer to external force variations. The image densities are usually different between color planes (in non-neutral images), and different amounts of heat are applied by the printhead in printing different color planes. The difference in printing temperatures affect the coefficient of friction at the printhead-donor medium interface, which leads to variations in the resistive forces on the donor medium, the receiver medium, and the platen roller. This variation in the resistive forces produces different amount of shear distortion (or wind up) in the rubber layer on the platen roller, which leads to different movements in the receiver medium in different color planes, that is, color misregistration.

One technique that can reduce shear distortion and thus color misregistration in a platen-drive mechanism is to increase the shear modulus in the elastomer layer of the platen roller. But an increase in the shear modulus tends also to decrease the compliance in the platen roller, which is undesired for printing uniformity.

DISCLOSURE OF THE INVENTION

It is an object of the present invention to overcome the above-mentioned difficulty by providing a platen roller structure that improves color registration without compromising compliance in the platen drive mechanism.

It is another object of the present invention to enable the use of a low-cost platen drive mechanism with improved color registration and without compromise in compliance in the nip between the platen roller and the printhead.

It is still another object of the present invention to improve color registration without changing printing procedure or requiring additional mechanical parts in the resistive thermal printer.

According to a feature of the present invention, a platen drive mechanism includes a thermal printhead having an array of selectively-activatable thermal elements; and a rotatably-driven platen roller opposed to the printhead and forming a nip with the printhead through which a receiver medium is driven by the platen roller while the thermal elements are selectively activated, wherein the platen roller has an outer layer of perfluorinated polymer that modifies the shear properties of the platen roller without reducing the platen's compliance.

According to a preferred embodiment of the present invention, the platen roller includes a compliant layer below the outer layer of perfluorinated polymer.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
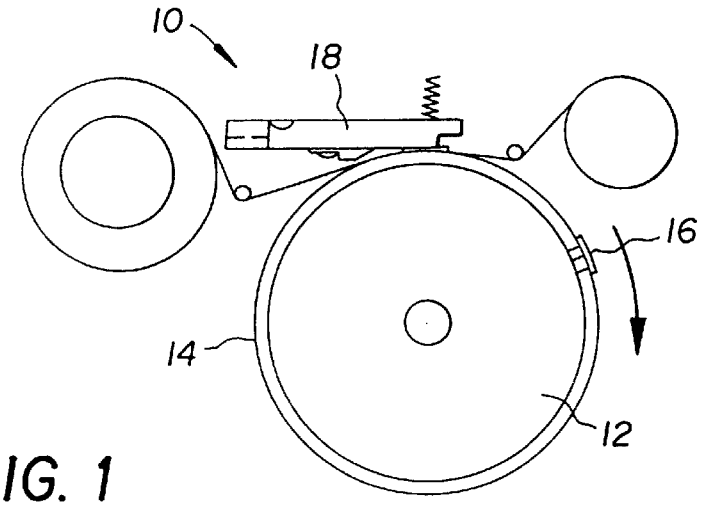
FIG. 1 is a schematic side view of a clamp and drum receiver medium transport mechanism known in the prior art.
Figure 2:
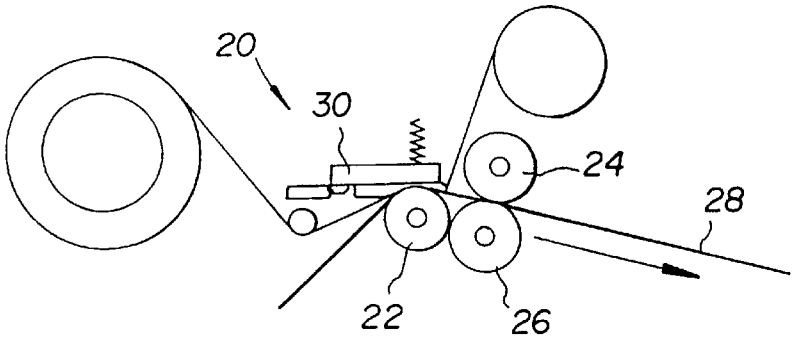
FIG. 2 is a schematic side view of a capstan roller receiver medium transport mechanism known in the prior art.
Figure 3:
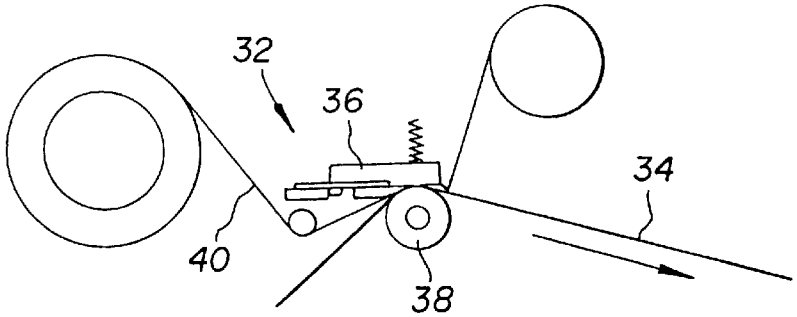
FIG. 3 is a schematic side view of a platen drive receiver medium transport mechanism known in the prior art.
Figure 4:
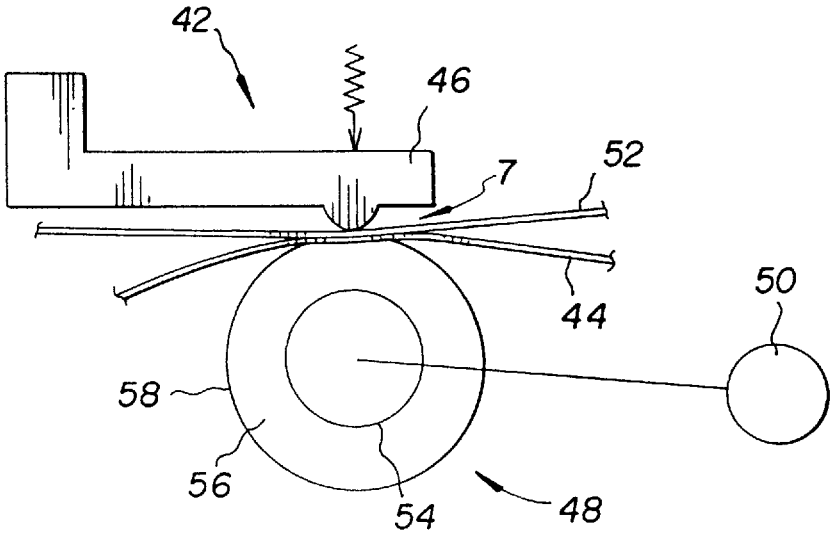
FIG. 4 is a schematic side view of a platen drive receiver medium transport mechanism according to the present invention.

Referring now to FIG. 4, there is shown a portion 42 of a dye transfer thermal printer apparatus similar to that of FIG. 3, but including structure according to the present invention. Receiver medium 44 is moved through a nip 7 between a resistive thermal printhead 46 and a platen roller 48. The platen roller is driven by a drive power source such as a motor 50, and itself drives the receiver medium and a donor medium 52 through the nip.

Figure 5:
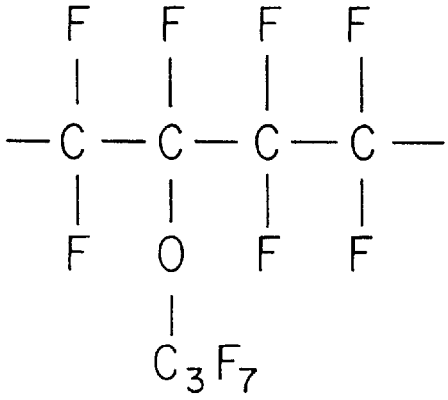
FIG. 5 illustrates the molecular structure of one example of a material according to the present invention.

Platen roller 48 includes a rigid shaft 54, usually made of metal for mechanical strength, and a compliant layer 56, such as an elastomer, wrapped around the shaft for compliance. According to the present invention, compliant layer 56 is covered by a layer 58 of perfluorinated polymer. The molecular structure of one example of perfluorinated polymer is illustrated in FIG. 5.

As an example of the invention concept, platen roller 48 may be formed of a 0.5 inch diameter steel shaft 54 and a 0.105 inch thick silicone elastomer layer 56 wrapped around the steel shaft. Platen roller is coated with a 0.002 inch thick perfluorinated polymer layer 58 on the outer surface of the silicone layer.

During testing of the apparatus, two platen rollers were mounted in a platen drive mechanism for testing color misregistration. The durometer of the elastomer of the two rollers were measured at approximately 30 Shore A. One of the rollers had a perfluorinated polymer coating, and the other did not. Receiver mediums were supplied in the form of cut sheets. The coating structure of the thermal reciever used was disclosed in commonly assigned U.S. Pat. No. 5,244,861. The receiver contains a paper stock Vintage Gloss that is extrusion laminated with a microvoided composite film. A subbing layer, a dye receiving layer, and a dye receiver overcoat layer are sequentially coated on top of the composit film. The backside of the receiver is first extrusion coated with a layer of high density polyethylene (30 g/m$^2$) and then coated with a layer for antistatic charge. The antistatic layer contains 4% polystyrene beads of 3 $\mu$m to 4 $\mu$m in diameter. The test image used contains fiducial marks along two in-line sides of the print with constant spacing and a uniform magenta field at maximum density. This test image was used to produce maximum difference in the friction force between color planes and thus the maximum color misregistration. The worst color misregistration occurred at the bottom of the prints. Multiple prints were made at 5 ms/line using each of the two platen rollers. The performance of the two rollers are summarized in the following table, which compares the color registration offset of the yellow and magenta color planes relative to the cyan color plane in the down-the-page direction for a platen roller with a perfluorinated polymer coating and a platen roller with no coating. Clearly, the platen roller with a perfluorinated polymer coating gives much improved color registration compared to a platen roller without a coating.

TABLE

| | Offset (0.001 inch) | |
|---|---|---|
| | Roller without Coating | Roller with perfluorinated polymer coating |
| Average Misregistration | −15.6 | −0.3 |
| Standard Deviation | 5.2 | 3.1 |

Similar color registration improvement have been experimentally observed on platen rollers coated with the perfluorinated polymers under the following parameters:

| Elastomer Layer Thickness* | Shore A Durometer | Perfluorinated Polymers Coating Thickness |
|---|---|---|
| 0.105" | 30 | 0.002" |
| 0.105" | 20 | 0.002" |
| 0.105" | 10 | 0.002" |
| 0.067" | 20 | 0.002" |
| 0.030" | 20 | 0.002" |
| 0.105" | 30 | 0.007" |

The outer diameter of the platen roller is fixed at 0.710" and the diameter of the steel core is varied accordingly.

In contrast, a coating with TEFLON™ material did not improve color registration. Two platen rollers were tested. A platen roller with a 20 Shore A 0.105" thick Silicone rubber layer wrapper on 0.5" steel core was coated with a 0.002" layer of TEFLON™ material. Another platen roller had a 40 Shore A 0.105" thick polyurethane layer wrapper on 0.5" steel core and the roller was coated with a 0.002" layer of TEFLON™ material. Significant color misregistration remained on prints made using both platen rollers.

Moreover, by way of example only and not by way of limitation, the compliant layer may have a durometer reading of between about 5 Shore A and about 60 Shore A. In addition, by way of example only and not by way of limitation, the perfluorinated polymer may have a thickness of between about 0.002 inch and 0.020 inch while the compliant layer has a thickness of between about 0.105 inch and 0.30 inch.

It will be understood by those skilled in the art that the coefficient of friction needs to be large enough so that the receiver medium can be transported by the platen roller under a normal head load such as approximately thirteen pounds for a page-wide printhead. It will be further understood that the perfluorinated polymer layer should be strong enough so that it can reduce any bulging effect that may occur when a soft elastomeric layer is driven by the printhead-platen interface. The reduction in this bulging effect decreases wind-up in the elastomer layer, and is thus likely responsible for the improved color registration in the platen-drive mechanism.

The invention has been described in detail with particular reference to preferred embodiments thereof, but it will be understood that variations and modifications can be effected within the spirit and scope of the invention.

| | |
|---|---|
| 10 resistive thermal printer | 56 compliant layer |
| 12 compliant platen roller | 58 perfluorinatedpolymer coating |
| 14 dye receiver medium | 60 |
| 16 clamp | 62 |
| 18 thermal printhead | 64 |
| 20 resistive thermal printer | 66 |
| 22 compliant platen roller | 68 |
| 24 pinch roller | 70 |
| 26 pinch roller | 72 |
| 28 dye receiver medium | 74 |
| 30 thermal printhead | 76 |
| 32 resistive thermal printer | 78 |
| 34 dye receiver medium | 80 |
| 36 thermal printhead | 82 |
| 38 compliant platen roller | 84 |
| 40 dye donor medium | 86 |
| 42 resistive thermal printer portion | 88 |
| 44 receiver medium | 90 |
| 46 resistive thermal printhead | 92 |
| 48 platen roller | 94 |
| 50 drive power source motor | 96 |
| 52 donor medium | 98 |
| 54 rigid shaft | |
| 100 | 150 |
| 102 | 152 |
| 104 | 154 |
| 106 | 156 |
| 108 | 158 |
| 110 | 160 |
| 112 | 162 |
| 114 | 164 |
| 116 | 166 |
| 118 | 168 |
| 120 | 170 |
| 122 | 172 |
| 124 | 174 |
| 126 | 176 |
| 128 | 178 |
| 130 | 180 |
| 132 | 182 |
| 134 | 184 |
| 136 | 186 |
| 138 | 188 |
| 140 | 190 |
| 142 | 192 |
| 144 | 194 |
| 146 | 196 |
| 148 | 198 |

What is claimed is:

1. A resistive thermal printer for forming an image on a receiver medium, said printer comprising:

a thermal printhead having an array of selectively-activatable thermal elements; and a rotatably-driven platen roller opposed to the printhead and forming a nip with the printhead through which a receiver medium is driven by the platen roller while the thermal elements are selectively activated, wherein the platen roller has an outer layer of perfluorinated polymer of between about 0.002 inch to about 0.007 inch thick and a compliant layer below the outer layer of perfluorinated polymer to modify shear distortion of the platen roller without reducing compliance of the roller, the compliant layer having a thickness of about 0.105 inch and a durometer reading of between about 5 Shore A and about 60 Shore A.

2. A resistive thermal printer as set forth in claim 1 wherein the outer layer of perfluorinated polymer has a thickness of between about 0.001 inch to about 0.020 inch.

3. A resistive thermal printer as set forth in claim 1, wherein the compliant layer is silicone rubber.

4. A resistive thermal printer as set forth in claim 1, wherein the compliant layer is polyurethane.

5. A resistive thermal printer for forming an image on a receiver, said printer comprising:

a source of dye donor medium;

a source of dye receiver medium;

a thermal printhead having an array of selectively-activatable thermal elements, heat from each activated element applied directly to the dye door medium to cause transfer of the dye by diffusion to the dye receiver medium; and a rotatably-driven platen roller opposed to the printhead and forming a nip with the printhead through which a receiver medium is driven by the platen roller while the thermal elements are selectively activated, wherein the platen roller has an outer layer of perfluorinated polymer of between about 0.002 inch and about 0.020 inch thick and a compliant layer below the outer layer of perfluorinated polymer to modify shear distortion properties of the platen roller, the compliant layer having a thickness of between about 0.105 inch and 0.30 inch and a predetermined durometer reading.

6. A resistive thermal printer as set forth in claim 5 wherein the perfluorinated polymer layer is approximately 0.001 inch to approximately 0.020 inch thick.

7. A resistive thermal printer as set forth in claim 5 wherein the compliant layer has a durometer reading of between about 10 Shore A and about 50 Shore A.

8. A resistive thermal printer as set forth in claim 5 wherein the compliant layer has a durometer reading of between about 5 Shore A and about 60 Shore A.

9. A resistive thermal printer as set forth in claim 5 wherein the compliant layer has a thickness of between about 0.03 inch and about 0.30 inch.

10. A resistive thermal printer as set forth in claim 5, wherein the compliant layer is silicone rubber.

11. A resistive thermal printer as set forth in claim 5, wherein the compliant layer is polyurethane.

* * * * *